US005718981A

United States Patent [19]

Fleischer et al.

[11] Patent Number: 5,718,981

[45] Date of Patent: Feb. 17, 1998

[54] POLYESTER PHOTOGRAPHIC FILM SUPPORT

[75] Inventors: Cathy Ann Fleischer; William Patrick McKenna; Kenneth William Best, all of Rochester, N.Y.

[73] Assignee: Eastman Kodak Company, Rochester, N.Y.

[21] Appl. No.: 595,613

[22] Filed: Feb. 2, 1996

[51] Int. Cl.[6] ..... G08C 1/76

[52] U.S. Cl. ..... 428/483; 430/534; 430/535; 430/523

[58] Field of Search ..... 428/483; 430/534, 430/535, 523

[56] References Cited

U.S. PATENT DOCUMENTS

| | | | |
|---|---|---|---|
| 2,681,294 | 6/1954 | Beguin | 117/34 |
| 2,761,791 | 9/1956 | Russell | 117/34 |
| 2,941,898 | 6/1960 | Wynn | 117/34 |
| 3,508,947 | 4/1970 | Hughes | 117/34 |
| 3,526,528 | 9/1970 | Takahashi et al. | 117/34 |
| 3,892,575 | 7/1975 | Watts et al. | 96/84 |
| 3,933,607 | 1/1976 | Needles et al. | 204/159.15 |
| 3,977,954 | 8/1976 | Needles et al. | 204/159.12 |
| 4,267,202 | 5/1981 | Nakayama et al. | 427/40 |
| 4,267,207 | 5/1981 | Sasazawa et al. | 427/129 |
| 4,278,703 | 7/1981 | Toy et al. | 427/54.1 |
| 4,689,359 | 8/1987 | Ponticello et al. | 524/23 |
| 4,695,532 | 9/1987 | Ponticello et al. | 430/533 |
| 4,824,699 | 4/1989 | Woo et al. | 427/307 |
| 4,933,267 | 6/1990 | Ishigaki et al. | 430/501 |
| 5,098,818 | 3/1992 | Ito et al. | 430/434 |
| 5,102,734 | 4/1992 | Marbrow et al. | 428/349 |
| 5,124,242 | 6/1992 | Hattori et al. | 430/523 |
| 5,209,849 | 5/1993 | Hu et al. | 210/490 |
| 5,236,817 | 8/1993 | Kim et al. | 430/503 |
| 5,368,997 | 11/1994 | Kawamoto | 430/534 |
| 5,378,592 | 1/1995 | Nakanishi et al. | 430/523 |
| 5,407,791 | 4/1995 | Kawamoto | 430/532 |
| 5,597,682 | 1/1997 | Ishii et al. | 430/534 |

FOREIGN PATENT DOCUMENTS

| | | |
|---|---|---|
| 0 521 605 A2 | 1/1993 | European Pat. Off. . |
| 8279232 | 5/1982 | Japan . |

OTHER PUBLICATIONS

Research Disclosure Item 17643, vol. 176, Dec. 1978, pp. 22–31.

Research Disclosure Item 22534, vol. 225, Jan. 1983, pp. 20–58.

*Primary Examiner*—Charles Nold

*Attorney, Agent, or Firm*—Robert A. Gerlach; Carl F. Ruoff

[57] ABSTRACT

A photographic film base comprising a polyester support have a photo-grafted layer of a monomer having a formula selected from:

(I)

(II)

or (III)

where $R_1$ is —OX or —$NX_2$; each $R_2$ is independently selected from X;

$R_3$ is X, —COOX or —$CONX_2$;

$R_4$ is —CHX—, —NH— or —O—;

$R_5$ is —CHX— or $$-\overset{O}{\overset{\|}{C}}-;$$

$R_6$ is X or —$(CH_2)_n$—COOX, where n is an integer of from 1 to 4 carbon atoms; and each X is independently selected from hydrogen or lower alkyl having 1 to 4 carbon atoms.

20 Claims, No Drawings

POLYESTER PHOTOGRAPHIC FILM SUPPORT

FIELD OF INVENTION

This invention relates to polyester photographic film support and to a method for making the same. More particularly, it relates to polyester supports, the surface of which is modified to increase the adhesion of subsequently applied layers.

BACKGROUND OF THE INVENTION

In photographic film manufacture, a gelatin layer containing the photographic chemicals is deposited onto a polymer film which provides support and mechanical integrity to the final product. Cellulosic or polyester supports, such as poly(ethylene terephthalate) (PET) and poly (ethylene naphthalate)(PEN), are typically employed. Polyesters have many desirable properties including high mechanical strength, dimensional stability, durability, optical clarity, and resistance to attack by most chemicals. However, the chemical inertness of PET and PEN also results in difficulty in obtaining acceptable adhesion of polar materials, such as gelatin-based photographic emulsions, to PET and PEN substrates.

To obtain acceptable adhesion of the light-sensitive emulsion layer to the support, intermediate anchoring layers are applied to the polyester film support prior to the orientation and crystallization of the support. Adhesion of the anchoring, or subbing, layer is promoted by a variety of methods, including the used of chlorine-containing copolymers, the application of the adhesive layer prior to the orientation and heat setting or crystallization of the polyester, and the addition of organic solvents which attack the polyester film surface. In addition, a subsequent gelatin-containing layer is often required prior to photographic emulsion coating.

Disadvantages of the above described approaches include the requirement of organic solvents, such as chlorophenol and resorcinol, which pose an environmental problem. Further, chlorinated materials degrade at elevated temperature and therefore are difficult to recycle in the polyester extrusion process. This causes economic and environmental problems. In addition, it is often necessary to apply a subbing layer to a polyester film which is already biaxially oriented and heat set. It is more difficult to obtain adhesion to biaxially oriented polyester support as compared to unoriented polyester. Solvents used to attack the polyester surface are less effective on the oriented support. In this case, polymer surface treatments, such as corona discharge (CDT), ultraviolet (UV), and glow discharge (GDT) treatments, are used to promote adhesion through introduction of specific functional groups which interact with subsequent coating layers as described in U.S. Pat. No. 4,695,532; U.S. Pat. No. 4,689,359; U.S. Pat. No. 4,933,267; U.S. Pat. No. 5,098,818, and U.S. Pat. No. 5,407,791. CDT provides sufficient adhesion improvements for many subbing applications, as demonstrated in U.S. Pat. Nos. 4,695,532 and 5,102,734, and is performed at atmospheric conditions so is inexpensive relative to other surface treatment methods; however, GDT provides more dramatic surface modification and rearrangement which is often necessary to obtain the desired adhesion. However, GDT is a vacuum technique requiring either very large vacuum chambers (for batch treatment) or expensive interlocks for air-to-air, in-line treatment. UV treatment is preferred because it provides the necessary surface modification and can be conducted at atmospheric conditions so is less expensive than GDT.

UV treatment, as an approach to polyester surface treatment, is referred to in, for example, U.S. Pat. No. 5,407,791; U.S. Pat. No. 3,892,575; U.S. Pat. No. 4,824,699 and U.S. Pat. No. 5,098,818. In U.S. Pat. No. 5,407,791, a gel sub with high chlorophenol levels was used to obtain adhesion to UV treated PEN. In expired U.S. Pat. No. 3,892,575, a polymer/gelatin blend was grafted to polyester using UV radiation. Grafting of monomers to polymer surfaces for surface modification and adhesion improvement (not for photographic applications) is described in U.S. Pat. No. 4,267,202; U.S. Pat. No. 5,209,849; U.S. Pat. No. 3,977,954; U.S. Pat. No. 4,278,703; JP Kokoku Patent Hei[1991]-6225, and EP Patent Application 521 605 A2.

Problem to be Solved by the Invention

Thus, there is a need for polyester photographic film supports to which subsequently applied layers will readily adhere.

Further, there is a need to provide a means for obtaining excellent adhesion of photographic emulsion to oriented polyester support.

SUMMARY OF INVENTION

The invention provides a photographic film base comprising a polyester support have a photo-grafted layer of a monomer having a formula selected from:

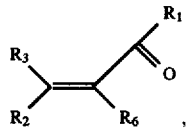

(I)

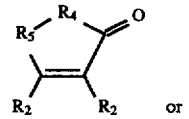

(II)

or

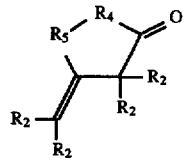

(III)

where $R_1$ is —OX or —$NX_2$; each $R_2$ is independently selected from X;

$R_3$ is X, —COOX or —$CONX_2$;

$R_4$ is —CHX—, —NH— or —O—;

$R_5$ is —CHX— or $$-\overset{\overset{\displaystyle O}{\|}}{C}-;$$

$R_6$ is X or —$(CH_2)_n$—COOX, where n is an integer of from 1 to 4 carbon atoms; and each X is independently selected from hydrogen or lower alkyl having 1 to 4 carbon atoms.

The invention also provides a method of making a polyester photographic film support by coating a polyester film support with a photo-graftable monomer as defined above and causing the photo-grafting of the monomer.

Advantageous Effect of the Invention

The present invention provides a silver halide photographic element which exhibits excellent adhesion between an emulsion layer and an oriented polyester support.

DESCRIPTION OF PREFERRED EMBODIMENTS

Thus, the invention contemplates a polyester photographic support having a photo-grafted layer of a monomer having the formula set forth above on at least one surface thereof. Further, the invention contemplates photographic elements having at least one light-sensitive silver halide emulsion layer on the exposed surface of the photo-grafted monomer layer. In addition, the invention contemplates a method of making a photographic support and element wherein a photo-graftable monomer is applied to the surface of a polyester sheet which has either been previously or subsequently exposed to radiation.

Any suitable polyester may be employed in the practice of this invention as the photographic film support, including polyethylene terephthalate, polyethylene napthalate, polyethylene isothalate, polybutalene terephthalate, polyethylene cocyclohexane dimethylterephthalate, polyethanol codimethanol cyclohexane napthalate, polycarbonates, copolymers and blends thereof and the like.

Photo-graftable monomers having the structure (I) above include α,B-unsaturated carboxylic acids such as acrylic acid, methacrylic acid, maleic acid, itaconic acid, α,B-unsaturated esters such as dimethyl fumonate, monoethyl ester of fumonic acid, α,B'-unsaturated amides such as methacrylamide acrylamide, n-methyl acrylamide, n-ethyl acrylamide, n-propyl acrylamide, n-butyl acrylamide, m-butyl methacrylamide, and furaramide and the like.

Photo-graftable monomers having the structure (II) above include α,B-unsaturated cyclic anhydrides such as maleic anhydride, dimethylmaleic anhydride, α,B-unsaturated cyclic imides such as maleimide, n-butyl maleimide, furanone and the like.

Photo-graftable monomers having the structure (III) above include α,B-unsaturated cyclic esters such as itaconic anhydride.

In the preparation of the photographic support in accordance with this invention, the photo-graftable monomer may be applied to the polyester at any suitable point in the preparation of the polyester. For example, the photo-graftable monomer may be applied after extrusion of the polyester into a sheet before any orientation of the polymer sheet is carried out, it may be applied after orientation in a first direction such as, for example, in the machine direction or it may be applied after the biaxial orientation is completed, for example, should the polyester first be subjected to a machine direction stretching and subsequently to a transverse direction stretching, the photo-graftable monomer may be applied at any point in the procedure.

The photo-graftable monomer can be applied to the polyester support either from an organic solvent coating composition or from an aqueous solution or dispersion. Any suitable organic solvent, capable of wetting the support, may be used such as, for example, acetone, methylethyl ketones, methanol, ethanol, isopropanol, n-propanol, butanol, dichloromethane, dichloroethane, toluene, hexane, heptane, and mixtures thereof. Similarly, the photo-graftable monomer may be applied to the polyester support from an aqueous solution or dispersion employing a suitable surface active agent to promote wetting of the support. The photo-graftable monomer is employed in a concentration of from 0.01 to 20 weight percent, preferably from 0.01 to 5 weight percent based on the total weight of the coating composition. The dry coverage of the photo-graftable monomer layer varies from 0.05 to 40 mg/dm$^2$ and preferably from 0.5 to 2 mg/dm$^2$.

Photo-graftable monomer solutions or dispersions described above may contain photosensitizers including alpha-diketones as described in U.S. Pat. No. 3,933,607, free radical producers such as benzoin ethers and azobisisobutyronitrile, triplet state sensitizers such as benzophenone, photo-redox photosensitizers, and dye-reduction photosensitizers as described in U.S. Pat. No. 4,267,207. In the application of the photo-graftable monomer layer, it may be desirable to include a hydrophilic binder such as, for example, gelatin, gelatin derivatives, casein, agar, sodium alginate, starch, polyvinyl alcohol, polyacrylic acid copolymer, maleic anhydride copolymer, cellulose ester, such as carboxymethyl cellulose and hydroxy ethyl cellulose; latex polymers such as a vinyl chloride-containing copolymer, a vinylidene chloride-containing copolymer, an acrylic acid ester-containing copolymer, a vinyl acetate-containing copolymer, a butadiene-containing copolymer, and the like. Gelatin is preferred. It may also be desirable to apply a layer of a hydrophilic binder, preferably a gel sub to the photo-graftable layer either simultaneously with, sequentially or after exposing the photo-graftable layer to suitable radiation. The photo-graftable layer, when a hydrophilic binder is also employed, or the gel sub over the photo-graftable layer, may contain antistatic agents, matting agents, surface active agents, crosslinking agents, photosensitizers, dyes and the like.

When a hydrophilic binder, such as gelatin, is employed in the photo-graftable monomer layer, it is used in an amount of from 0.25 to 5 weight percent, preferably 0.5 to 1 weight percent with the photo-graftable monomer being present in the concentration of 0.01 to 10 weight percent, preferably 0.1 to 2 weight percent based on the weight of the coating composition. The photo-graftable monomer-hydrophilic binder solutions are coated to obtain a dry overall coverage ranging from 0.2 mg/dm$^2$ to 60 mg/dm$^2$, preferably from 1 to 10 mg/dm$^2$.

The photo-graftable monomer layer can be coated by any suitable coating process well known in the art, for example, dip coating, air knife coating, curtain coating, roller coating, wire bar coating, gravure coating, or extrusion, utilizing a hopper as described in U.S. Pat. No. 2,681,294. When two or more layers are coated they can be applied sequentially or simultaneously according to the processes described in U.S. Pat. Nos. 2,761,791; 3,508,947; 2,941,898 and 3,526,528. The photo-graftable monomer layer is exposed to suitable radiation to bring about the photo-grafting of the monomer. The radiation may be directed onto the photo-graftable layer itself or on the substrate prior to the application of the photo-graftable layer thereto. When a hydrophilic layer is disposed adjacent to the photo-graftable layer, the radiation may be applied to the combination of layers. Any suitable radiation treatment for the photo-graftable layer may be employed such as, for example, corona discharge treatment, flame treatment, high energy visible light treatment, ultraviolet light, high frequency wave treatment, glow discharge treatment, active plasma treatment, laser treatment and the like. Ultraviolet light is the preferred radiation source. Ultraviolet radiation in the range of 170 nm to 400 nm is most preferred. This can be obtained by utilizing a quartz UV lamp. A preferred intensity of UV radiation is from 100 to 5000 mJ/cm$^2$, and most preferably from 800 to 2400 mJ/cm$^2$ as measured by a UVICURE high energy UV integrating radiometer produced by Electronic Instrumentation and Technology, Inc., Sterling, Va. Where a hydrophilic layer is applied over the photo-graftable layer, the radiation can be applied through the overcoat layer. Following coating of the hydrophilic layer or the monomer-hydrophilic binder blend, either prior to or after radiation treatment, the coating is dried at a temperature between 60° C. and 140° C., preferably between 100° C. and 130° C.

Subsequent to the application of the photo-graftable monomer layer to the polyester support and the treatment thereof with radiation, the layer is coated with a photosensitive layer or layers that contain photographic silver halide emulsion. In this regard, the polyester substrate may have a single photo-grafted monomer layer on its surface, a photo-grafted monomer layer which also contains a hydrophilic colloid, such as mentioned above, or it may be a plurality of layers where the layer closest and adjacent to the support is a photo-grafted layer with the layer immediately above being a hydrophilic colloid, preferably a gel sub layer. The invention is applicable to both negative and reversal silver halide elements. For reversal films, the emulsion layers as taught in U.S. Pat. No. 5,236,817, especially Examples 16 and 21 are particularly suitable. Any of the known silver halide emulsion layers, such as those described in *Research Disclosure*, Vol. 176, December 1978, Item 17643 and *Research Disclosure* Vol. 225, January 1983, Item 22534 are useful in preparing photographic elements in accordance with this invention. Generally, one or more layers comprising a dispersion of silver halide crystals in an aqueous solution of gelatin are applied to the substrate having a photo-graftable monomer layer. The coating process can be carried out on a continuously operating machine wherein a single layer or a plurality of layers are applied. For multicolor elements, layers can be coated simultaneously on the composite support film as is described in U.S. Pat. Nos. 2,761,791 and 3,508,947. Additional useful coating and drying procedures are described in *Research Disclosure*, Vol. 176, December 1978, Item 17643. Suitable photosensitive image forming layers include those which provide color or black and white images.

The invention will be further illustrated by the following examples. The adhesion tests used are as follows:

Crosshatch Tape Dry Adhesion Test:

The emulsion surface of the green sample (before development) was crosshatched with a razor blade at 5 mm intervals to make nine squares. An adhesive tape (3M 610 tape) was adhered thereto and rapidly stripped off at a peel angle of 180° C. The adhesion was evaluated according to the estimated percent removal of the emulsion.

Dry Adhesion Test: 35 mm strips of coated samples are first processed using a C41 developing process. Then a sample approximately 1.9 cm wide and 15 cm long is prepared and a score line is cut across the sample through the emulsion coating near the top of the strip, about 2 cm from the top. A piece of 3M 471 ¾ Pressure Sensitive Vinyl Yellow Tape is applied onto the sample and excess sample is trimmed away from the tape with a sharp blade. The tape is slowly pulled back from the top to the score mark, trying to force the emulsion to peel off with the tape. The sample is placed in an Instron tensile testing machine and the amount of force required to remove the tape/emulsion at a rate of 100 cm/min. is recorded. Peel force values are reported in units of N/m with higher numbers indicating a stronger adhesive bond. If the emulsion could not be peeled off with this tape a "Did not peel" or DNP is reported.

Wet Adhesion Test: a 35 mm×12.7 cm strip of the coating is soaked at 37.8° C. for 3 min. 15 sec. in Kodak Flexicolor Developer Replenisher. The strip is then scored with a pointed stylus tip across the width of the strip and placed in a small trough filled with a developer solution. A weighted (900 g) filled natural rubber pad, 3.49 cm diameter, is placed on top. The pad is moved back and forth across the strip 100 times. The amount of emulsion removal is then assessed given in units of % removed. The lower the value the better the wet adhesion of the system.

EXAMPLES

Adhesion test results for the following examples are in Table 1.

Example 1

A photo-graftable composition A was prepared by dissolving maleic anhydride in acetone to obtain a 0.05M solution. The solution was coated onto 100 μm poly (ethylene naphthalate) (PEN) manufactured by Imperial Chemicals incorporated (ICI) using a 25 μm coating knife, to obtain a dry maleic anhydride coverage of approximately 1.4 mg/dm$^2$. Irradiation of the sample was conducted using the Fusions F300 curing system with model LC-6 benchtop conveyor (Fusions UV Curing Systems, 7600 Standish Place, Rockville, Md. 20855–2798). The coated PEN sample was passed under the lamp three times at a conveyor speed of 9.2 m/min (30 fpm). The lamp used was the D bulb (emission from 200 nm to 450 nm, with major output between 350 nm and 390 nm) with an output of 120 W/cm. The energy density of one pass under the lamp at 9.2 m/min (30 fpm) is approximately 800 mJ/cm$^2$ as measured by the UVICURE high energy UV integrating radiometer described previously. The irradiated sample was then coated on a 30° C. coating block with the following gel sub formulation:

1.0 weight percent gelatin 0.02 weight percent potassium chromium sulfate 0.01 weight percent saponin surfactant 98.97 weight percent deionized water The coated sample was then dried for 2 minutes at 120° C. in a standard convection oven. The coated sample was then coated with a thick emulsion pad of the first coated emulsion layer (antihilation layer) of black colloidal silver sol containing 0.236 g of silver with 2.44 g gelatin. Samples were incubated 24 hours at 32° C., 50% RH, or 10 days at 22° C., 50% RH prior to adhesion testing.

Comparison Example 1

The procedure in Example 1 was repeated, but the UV irradiation step was eliminated.

Example 2

The procedure of Example 1 was repeated using solution B, composed of 0.05M iraconic anhydride in acetone. The gelatin coated sample was dried for 5 minutes at 120° C. in a standard convection oven.

Example 3

The procedure of Example 1 was repeated using solution C, composed of 0.05M monoethylester of fumaric acid in acetone. The coated PEN sample was passed under the lamp six times at a conveyor speed of 9.2 m/min.

Example 4

The procedure of Example 1 was repeated using solution D, composed of 0.05M furanone in acetone. The coated PEN sample was passed under the lamp six times at a conveyor speed of 9.2 m/min.

Example 5

The procedure of Example 1 was repeated using solution E, composed of 0.05M methacrylamide in acetone. The coated PEN sample was passed under the lamp six times at a conveyor speed of 9.2 m/min.

Example 6

The procedure of Example 1 was repeated using solution F, composed of 0.05M maleimide in acetone. The gelatin coated sample was dried for 2 minutes at 120° C. in a standard convection oven.

Example 7

The procedure of Example 1 was repeated using solution G, composed of 0.05M n-butyl maleimide in acetone. The gelatin coated sample was dried for 5 minutes at 120° C. in a standard convection oven.

Example 8

A photo-graftable composition H was formulated as follows:

1.0 weight percent gelatin 0.5 weight percent maleic anhydride 0.02 weight percent potassium chromium sulfate 0.01 weight percent saponin surfactant 98.47 weight percent deionized water Composition H was stirred at 40° C. for 20 minutes. The solution was coated onto 100 μm PEN on a 30° C. coating block using a 50 μm coating knife, to obtain a dry coverage of approximately 7.5 mg/dm$^2$. The coated PEN sample was passed under the Fusions F300 curing system once at a conveyor speed of 9.2 m/min using the D bulb described in Invention Example 1. The coated samples were then dried for 2 minutes at 120° C. in a standard convection oven.

Example 9

The procedure of Example 8 was repeated using solution H, except that the PEN was UV treated with six passes at 9.2 m/min using the Fusions D bulb, prior to coating and the dry coverage aim was 1.7 mg/dm$^2$.

Example 10

The procedure of Example 9 was repeated using solution H, except that the UV treatment used was four passes at 9.2 m/min using the H+ Fusions system bulb. The output of the H+ bulb is distributed from 205 nm to 445 nm with the greatest average intensity between 205 to 300 nm.

The results of Examples 1–10 and Comparison Example 1 are set forth in Table I.

| Sample | Dry Adhesion (N/m) | Crosshatch Dry Tape Adhesion | Wet Adhesion |
|---|---|---|---|
| Example 1 (Invention) | DNP | A | A |
| Example 1 (Comparison) | 0 | D | D |
| Example 2 (Invention) | DNP | A | A |
| Example 3 (Invention) | | A | A |
| Example 4 (Invention) | | A | A |
| Example 5 (Invention) | DNP | A | A |
| Example 6 (Invention) | DNP | A | A |

-continued

| Sample | Dry Adhesion (N/m) | Crosshatch Dry Tape Adhesion | Wet Adhesion |
|---|---|---|---|
| Example 7 (Invention) | | A | A |
| Example 8 (Invention) | 60 | A/B | A/B |
| Example 9 (Invention) | DNP | A | A |
| Example 10 (Invention) | DNP | A | A |

Definition of Codes:
Dry adhesion - maximum measurable peel strength is approximately 400 N/m.
DNP - does not peel (Emulsion could not be peeled off the support with the designated tape.)
Crosshatch dry tape adhesion and wet adhesion - A: 0–5% removed, B: 5–20% removed, C: 20–50% removed, D: 50–100% Removed.

Examples 11–20

The supports of Examples 1–10 having the antihalation layer described in Example 1 as Layer 1 are coated as follows, the quantities of silver halide given in grams (g) of silver per m$^2$, the quantities of the other materials are given in g/m$^2$:

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin.

Layer 6 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol % iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 8 {Third (most) Green-Sensitive Layer} Green sensitized silver iodobromide emulsion [4 mol % iodide, average grain diameter 2.16 microns, average grain thickness 0.12 microns] at 1.00 g, magenta dye-forming image coupler M-1 at 0.0.72 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye-forming image coupler Y-1 at 0.090 g, yellow dye-forming image coupler Y-2 at 0.23 g, cyan dye-forming image coupler C-10.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsensitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The formulas for the component materials are as follows:

C-1:

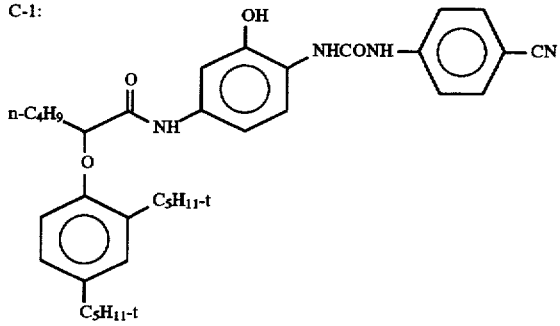

CM-1:

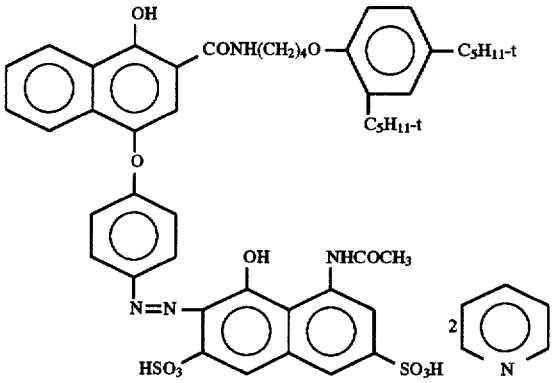

B-1:

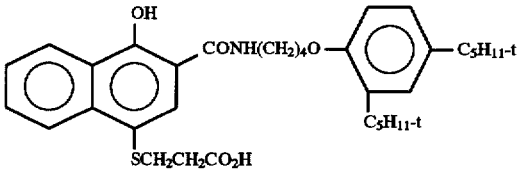

-continued
D-1:
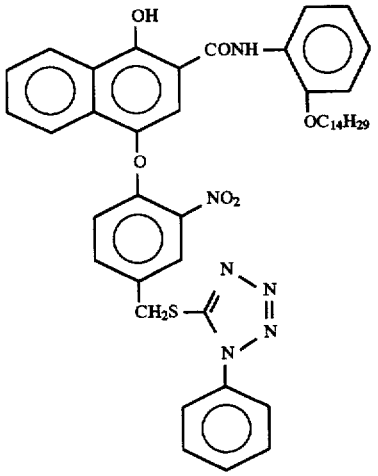
D-2:
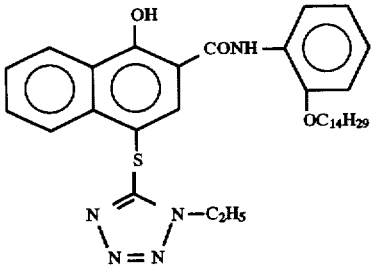
D-3:
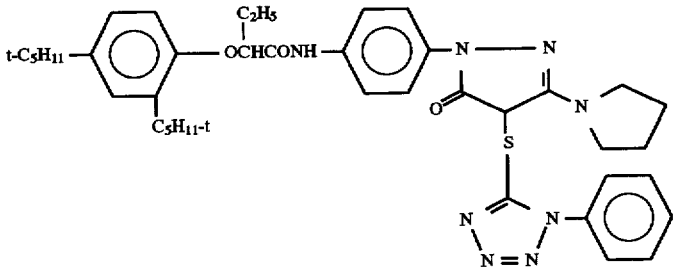
D-4:
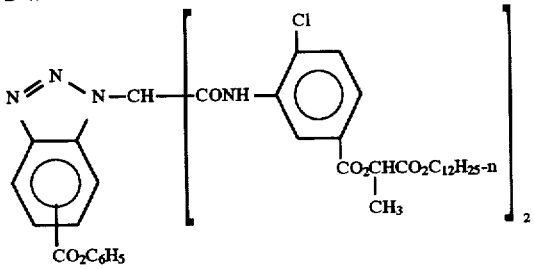

-continued
D-5
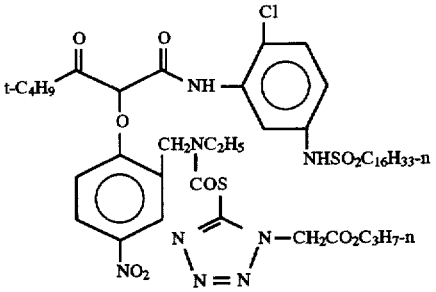
MM-1:
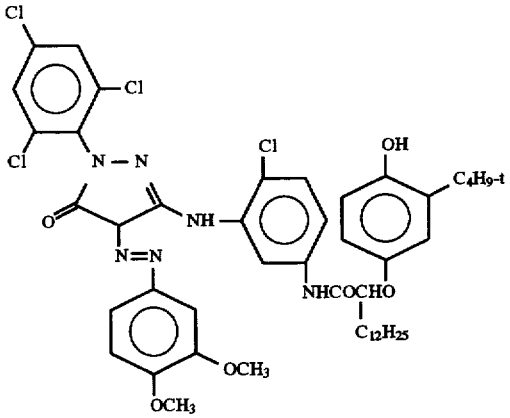
Y-1:
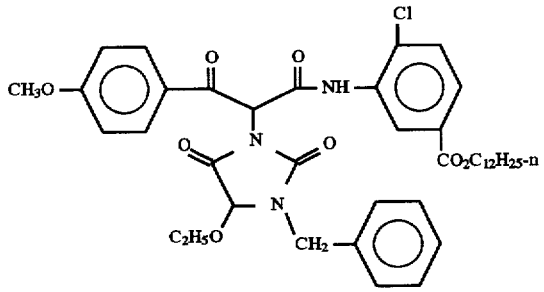
Y-2:
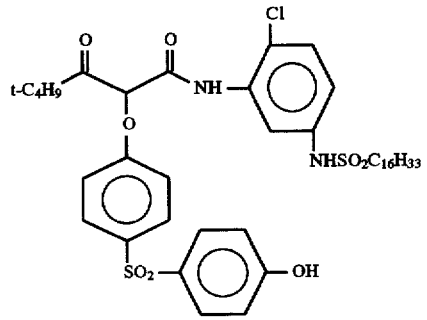

-continued
M-1:
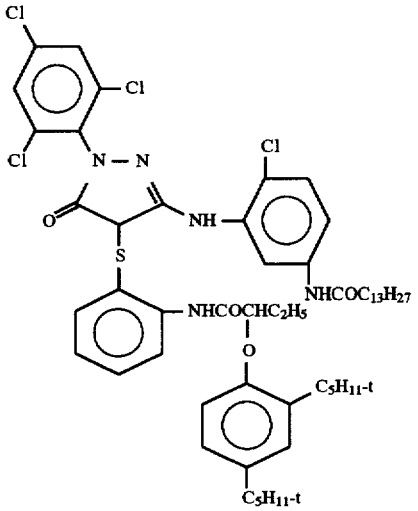
YD-1:
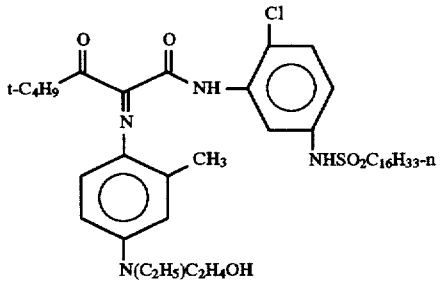
YD-2:
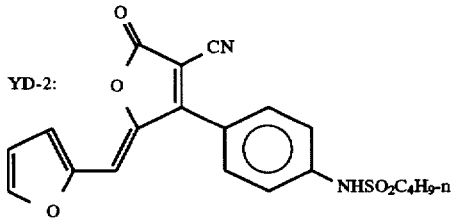
UV-1:
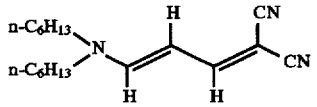
UV-2:
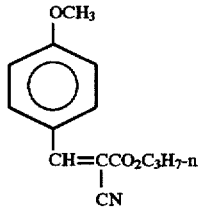
H-1:
$CH_2(SO_2CH{=}CH_2)_2$ Adhesion test results for Examples 11–20 are substantially the same as those reported in Table I for Examples 1–10.

What is claimed is:

1. A photographic film base comprising a poly-ester support having a photo-grafted layer of a monomer having a formula selected from:

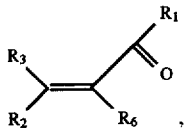
(I)

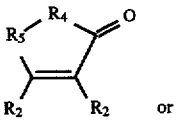
(II)

or

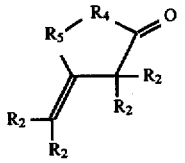
(III)

where $R_1$ is —OX or —$NX_2$; each $R_2$ is independently selected from X;

$R_3$ is X, —COOX or —$CONX_2$;

$R_4$ is —CHX—, —NH— or $R_5$ is —CHX— or $$-\overset{O}{\overset{\|}{C}}-;$$

$R_6$ is X or —$(CH_2)_n$—COOX, where n is an integer of from 1 to 4 carbon atoms;

and each X is independently selected from hydrogen or alkyl having 1 to 4 carbon atoms.

2. The photographic film base of claim 1 wherein the monomer has the formula:

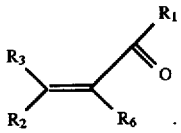
(I)

3. The photographic film base of claim 1 wherein the monomer has the formula:

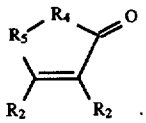
(II)

4. The photographic film base of claim 1 wherein the monomer has the formula:

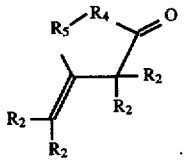
(III)

5. The photographic film base of claim 1 wherein the monomer is maleimide, methacrylamide, maleic anhydride, maleic acid, itaconic acid or itaconic anhydride.

6. The photographic film base of claim 1 wherein the polyester is polyethylene terephthalate or polyethylene naphthalate.

7. The photographic film base of claim 6 wherein the polyester is polyethylene naphthalate.

8. A process of making a photographic film base which comprises providing a polyester sheet, applying to the sheet a photo-graftable layer of a monomer having a formula selected from

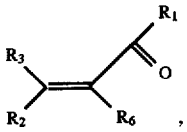
(I)

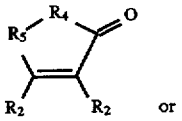
(II)

or

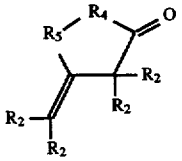
(III)

where $R_1$ is —OX or —$NX_2$; each $R_2$ is independently selected from X;

$R_3$ is X, —COOX or —$CONX_2$;

$R_4$ is —CHX—, —NH— or —O—;

$R_5$ is —CHX— or $$-\overset{O}{\overset{\|}{C}}-;$$

$R_6$ is X or —$(CH_2)_n$—COOX, where n is an integer of from 1 to 4 carbon atoms; and each X is independently selected from hydrogen or lower alkyl having 1 to 4 carbon atoms.

9. The process of claim 8 wherein photo-grafting is caused by energy treatment.

10. The process of claim 9 wherein the energy treatment is corona discharge, glow discharge or ultraviolet radiation.

11. The method of claim 10 wherein the treatment is ultraviolet radiation.

12. The process of claim 9 wherein the treatment is applied to the polyester sheet prior to the application of the photo-graftable layer.

13. The process of claim 9 wherein the treatment is applied to the polyester sheet subsequent to the application of the photo-graftable layer.

14. The process of claim 8 wherein the photo-graftable layer contains a binder.

15. The process of claim 14 wherein the binder is a hydrophilic polymer.

16. The process of claim 8 wherein a hydrophilic polymer layer is coated over the photo-graftable layer.

17. The process of claim 15 wherein the hydrophilic polymer is gelatin.

18. The process of claim 16 wherein the hydrophilic polymer is gelatin.

19. The process of claim 11 wherein the ultraviolet radiation has an intensity of from 100 to 5000 $mJ/cm^2$.

20. A photographic element having a film base of claim 1 overcoated with at least one light-sensitive silver halide layer.

* * * * *